US008302224B2

(12) United States Patent
Lehmann

(10) Patent No.: US 8,302,224 B2
(45) Date of Patent: Nov. 6, 2012

(54) BED COVERING

(75) Inventor: David Max Lehmann, San Diego, CA (US)

(73) Assignee: David Max Lehmann, San Diego, CA (US)

( * ) Notice: Subject to any disclaimer, the term of this patent is extended or adjusted under 35 U.S.C. 154(b) by 11 days.

(21) Appl. No.: 12/691,689

(22) Filed: Jan. 21, 2010

(65) Prior Publication Data

US 2011/0173750 A1 Jul. 21, 2011

(51) Int. Cl.
*A47G 9/00* (2006.01)

(52) U.S. Cl. ..... 5/486; 5/495

(58) Field of Classification Search ..... 5/482, 486, 5/513, 485, 494–499
See application file for complete search history.

(56) References Cited

U.S. PATENT DOCUMENTS

| | | | | | |
|---|---|---|---|---|---|
| 881,851 | A * | 3/1908 | Forwood | 5/499 |
| 2,450,923 | A * | 10/1948 | Spiro, Jr. | 5/499 |
| 3,072,776 | A * | 1/1963 | Quenneville | 219/212 |
| 4,005,499 | A * | 2/1977 | Klein | 5/485 |
| 4,304,018 | A | 12/1981 | McClam | |
| 4,546,508 | A * | 10/1985 | Ison | 5/494 |
| 6,643,871 | B1 * | 11/2003 | Robke | 5/486 |
| 6,968,582 | B1 * | 11/2005 | Barton et al. | 5/486 |
| 7,100,223 | B1 | 9/2006 | Anthony | |
| 7,302,721 | B1 * | 12/2007 | Dorr | 5/497 |
| 2006/0272093 | A1 | 12/2006 | Russ | |
| 2007/0061967 | A1 | 3/2007 | Fox | |

* cited by examiner

*Primary Examiner* — Robert G Santos
*Assistant Examiner* — Nicholas Polito
(74) *Attorney, Agent, or Firm* — Foley & Lardner LLP

(57) ABSTRACT

A bed covering made of a substantially rectangular fabric having a head end, a foot end and an unfolded width. A first series of fastening elements, proximate to the foot end, is arrayed on one side of a center line of the bed covering. A second series of fastening elements, proximate to the foot end and complementary to the first series, is arrayed on an opposing side of the center line. The first and second series of fastening devices allow the bed covering to be placed in a fastened configuration where the width of the foot end of the bed covering is less than the width of the head end of the bed covering.

14 Claims, 8 Drawing Sheets

FIG. 2
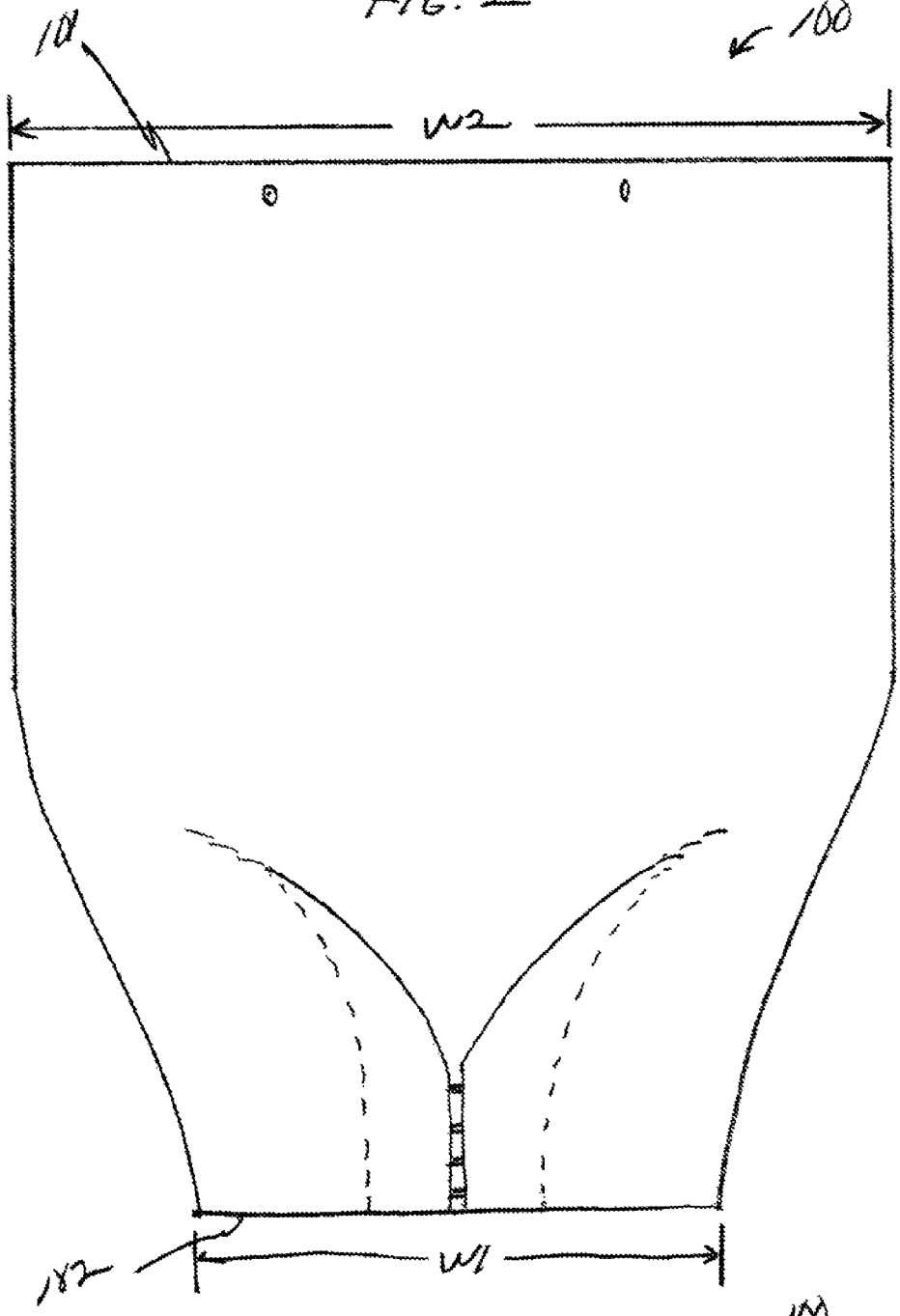
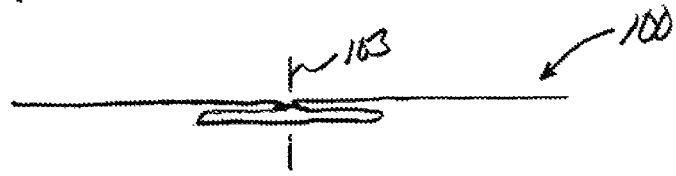
FIG. 3

200

101
W1
102
W1

BED COVERING

FIELD OF THE INVENTION

The present invention relates generally to bedding and, more particularly, to bed coverings configured to accommodate movement by individuals.

BACKGROUND OF THE INVENTION

A typical bedding set includes a fitted sheet and one or more top coverings such as a flat sheet, blanket, duvet, quilt, comforter or the like, which are sized to fit a specific mattress size, such as twin, double, queen or king. The fitted sheet generally wraps around the mattress for individuals to sleep thereon. The top covering is generally used to cover the individuals sleeping on the bed. Thus, the top covering is shared by all individuals sleeping in the bed.

When one individual in the bed moves, that individual may cause the top covering to be pulled off the other individual, causing disruption in the other individual's sleep. This regard, it is generally the pulling of the top portion of the covering (the portion near the head of the individual), as opposed to the bottom portion (the portion near the feet), that causes the sleep disruption.

SUMMARY OF THE INVENTION

In one aspect, the invention relates to a bed covering, comprising a substantially rectangular fabric having a head end, a foot end and an unfolded width, a first plurality of fastening elements proximate to the foot end and disposed on one side of a center line of the covering and a second plurality of fastening elements proximate to the foot end and disposed on an opposing side of the center line, wherein fastening one or more fastening elements of the first plurality of fastening elements to a complementary one or more fastening elements of the second plurality of fastening elements configures a portion of the covering proximate to the foot end to have a width that is less than the unfolded width.

In one embodiment, the portion of the covering proximate to the foot end is configured to be folded over a corresponding foot end of a bed, wherein the one or more of the first plurality of fastening elements and the one or more of the second plurality of fastening elements is configured to be tucked under the foot end of the bed.

BRIEF DESCRIPTION OF THE DRAWINGS

FIG. 2 illustrates the bed covering of FIG. 1 in a fastened configuration; FIG. 2 illustrates a bed covering in a folded configuration in accordance with an embodiment of the present invention;

FIG. 3 illustrates an end view of the bed covering of FIG. 2 in one embodiment;

DETAILED DESCRIPTION

Embodiments of the present invention provide an oversized bed covering in which at least the foot end of the covering can be narrowed through the use of fasteners. Thus, when fastened, the foot end may be sized according to the mattress size, for example, while there is sufficient extra width in the top portion (head end) to accommodate a sideways displacement of the covering by one bedmate without uncovering another bedmate.

Figure 1:
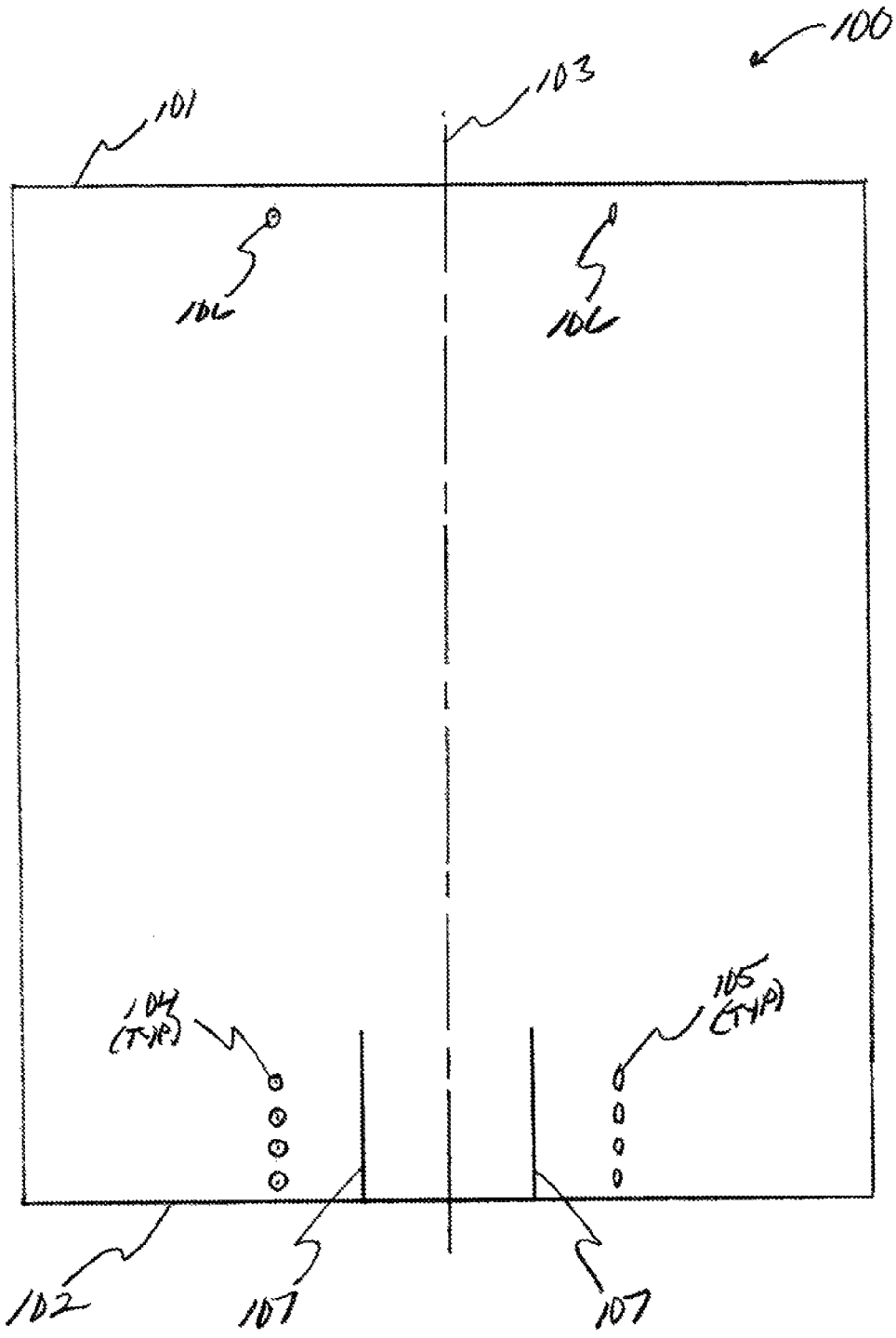
FIG. 1 illustrates a bed covering in an unfastened configuration in one embodiment of the present invention.

Referring now to FIG. 1, a bed covering in accordance with an embodiment of the present invention is illustrated. The bed covering 100 has a substantially rectangular shape and may be formed of any of a variety of fabrics or combination of fabrics including, but not limited to, cotton, wool, silk and rayon. The length of the bed covering 100 from the head end 101 to the foot end 102 may vary depending on the bed size.

As illustrated in the embodiment of FIG. 1, the bed covering 100 may be defined by a center line 103 extending from the head end 101 to the foot end 102, bisecting the bed covering 100. On one side of the center line 103, in a portion of the bed covering 100 proximate to the foot end 102, there is provided a plurality of fastening elements, such as buttons 104, substantially parallel to the center line 103. On the opposing side of the center line 103, in a portion of the bed covering 100 proximate to the foot end 102, there is provided a second plurality of fastening elements, such as button holes 105, substantially parallel to the center line 103 and positioned to complement the buttons 104. In this regard, each button 104 corresponds to a button hole 105 on the opposing side of the center line 103. In one embodiment, the bed covering 100 may also include a pair of complementary fastening elements 106 disposed in a portion of the bed covering 100 proximate to the head end 101.

While FIG. 1 illustrates that the fastening elements are buttons 104 and button holes 105, those skilled in the art will understand that other types of fastening elements may be used and are contemplated within the scope of the present invention. Such types of fastening elements may include, without limitation, complementing snaps, buckles and straps, ties and laced eyelets. And while FIG. 1 illustrates four pairs fastening elements, those skilled in the art will understand that more than four or fewer than four pairs of fastening elements may be used and are contemplated within the scope of the present invention.

Further, as illustrated in the embodiment of FIG. 1, the bed covering 100 may be provided with folding lines 107. The folding lines 107 may facilitate folding of the bed covering 100 and the alignment of the buttons 104 and complementing button holes 105 before the buttons 104 and button holes 105 are fastened. In various embodiments, the folding lines 107 may be formed within the fabric of the bed covering 100 through, for example, a permanent fold in the fabric or by stitching in the fabric of bed covering 100 that predisposes the fabric to fold along the line.

Referring now to FIG. 2, the bed covering 100 of FIG. 1 is illustrated in a fastened configuration. In the illustration of FIG. 2, the portion of the bed covering 100 proximate to the foot end 102 is folded at the folding lines 107 to align the buttons 104 with the complementing button holes 105, thus allowing the buttons 104 to be secured to the button holes 105. As illustrated in FIG. 3, which is an end view of the bed covering 100 of FIG. 2 in the fastened configuration, the folding creates a symmetrical folding of the bed covering 100 with respect to the center line 103.

In a fastened configuration, as illustrated in FIG. 2 the foot end 102 has a narrower width than the head end 101. In this regard, the width W1 of the foot end 102 may correspond to the width of a conventional bed sheet for a particular bed size. For example, for a queen-size bed, the foot end 102 may have a width W1 of 90 inches. On the other hand, the head end 101 has a width W2 that is larger than the conventional sheet size for the bed. For example, the width W2 may correspond to the width of a conventional top sheet for a king-size bed. In this regard, the width W2 of the head end 101 provides extra room for sideways displacement of the bed covering. The extra room allows one bedmate to shift the bed covering to their side of the bed without uncovering the other bedmate.

Figure 4:
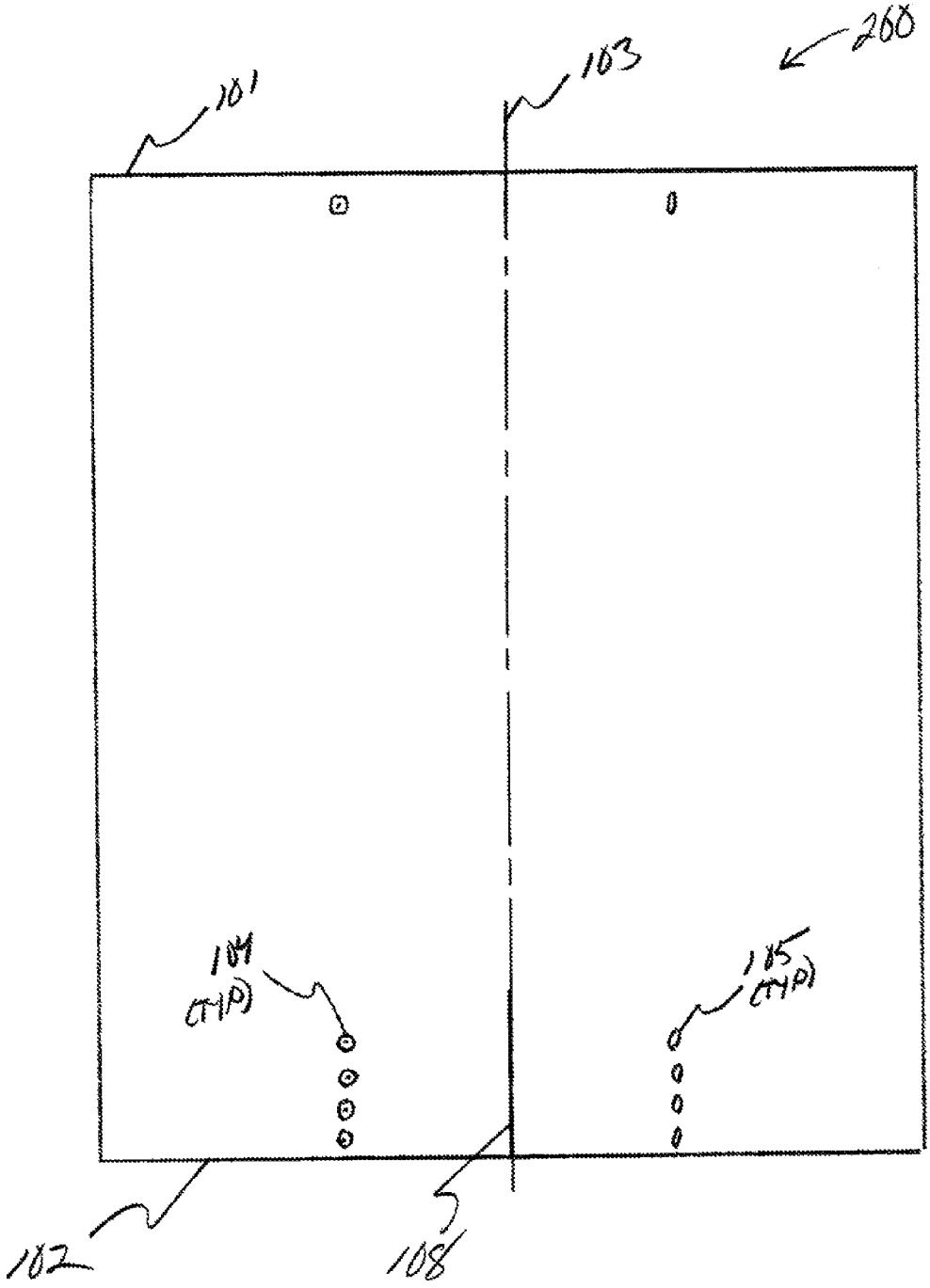
FIG. 4 illustrates a bed covering in an unfastened configuration in another embodiment of the present invention.
Figure 5:
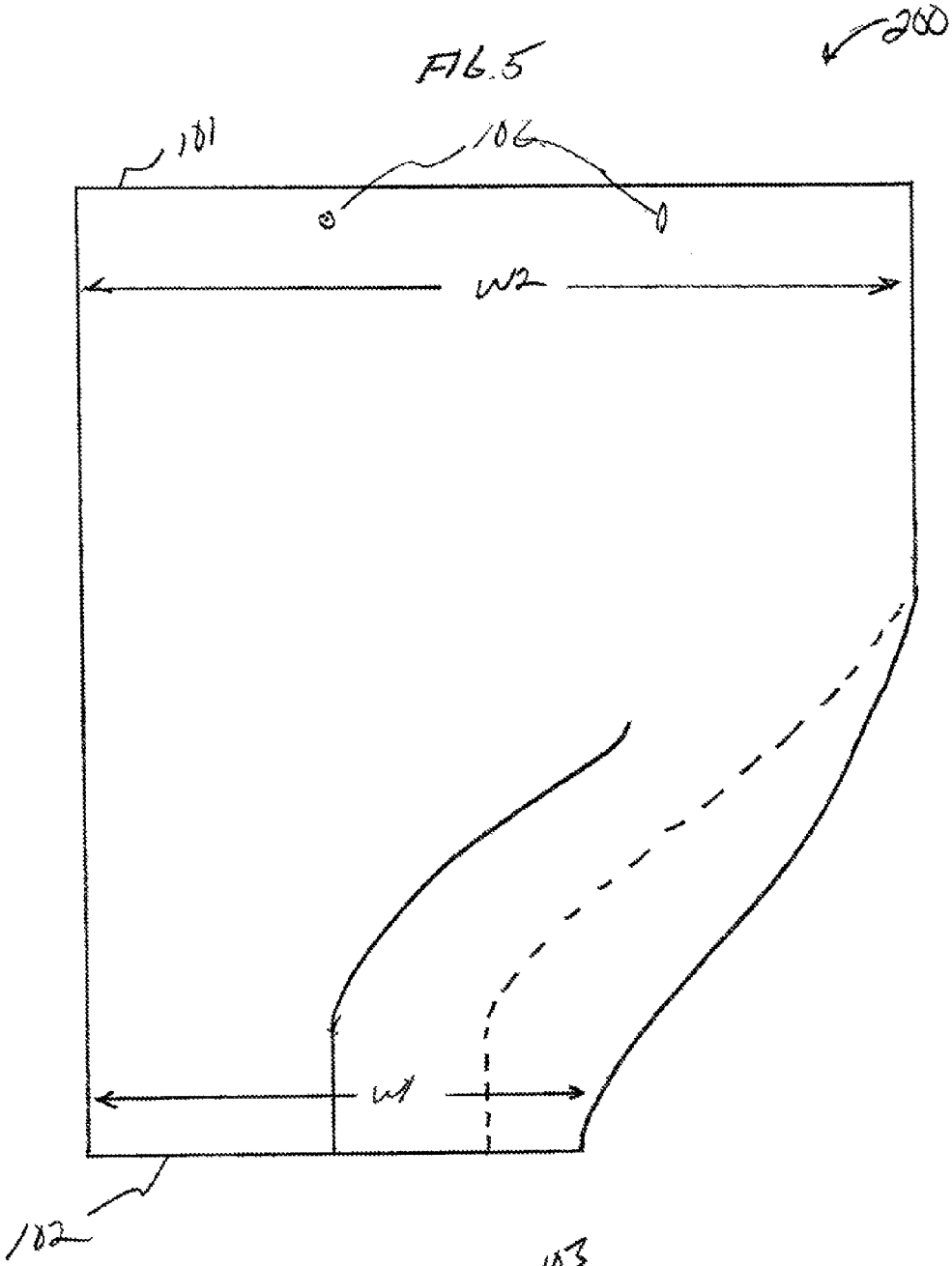
FIG. 5 illustrates the bed covering of FIG. 4 in a fastened configuration.
Figure 6:
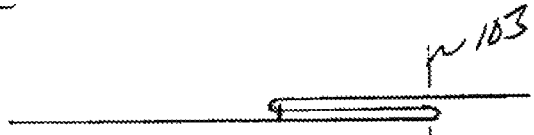
FIG. 6 illustrates an end view of the bed covering of FIG. 5 in one embodiment.

Referring now to FIG. 4, an alternative embodiment of the present invention 200 may include a folding line 108 that is substantially co-linear with the center line 103. In FIG. 5, the bed covering 200 of FIG. 4 is illustrated in a fastened configuration. In the illustration of FIG. 5, the portion of the bed covering 200 proximate to the foot end 102 is folded at the folding line 108 to align the buttons 104 with the complementing button holes 105, thus allowing the buttons 104 to be secured to the button holes 105. As illustrated in FIG. 6, which is an end view of the bed covering 200 of FIG. 5 in the fastened configuration, the folding creates a non-symmetrical folding of the bed covering 200 with respect to the center line 103, creating an unequal distribution of extra width at the head end 101. Such a folding configuration and the corresponding unequal distribution of extra width may be of greater utility when only one bedmate is responsible for sideways displacement of the bed covering.

Figure 7:
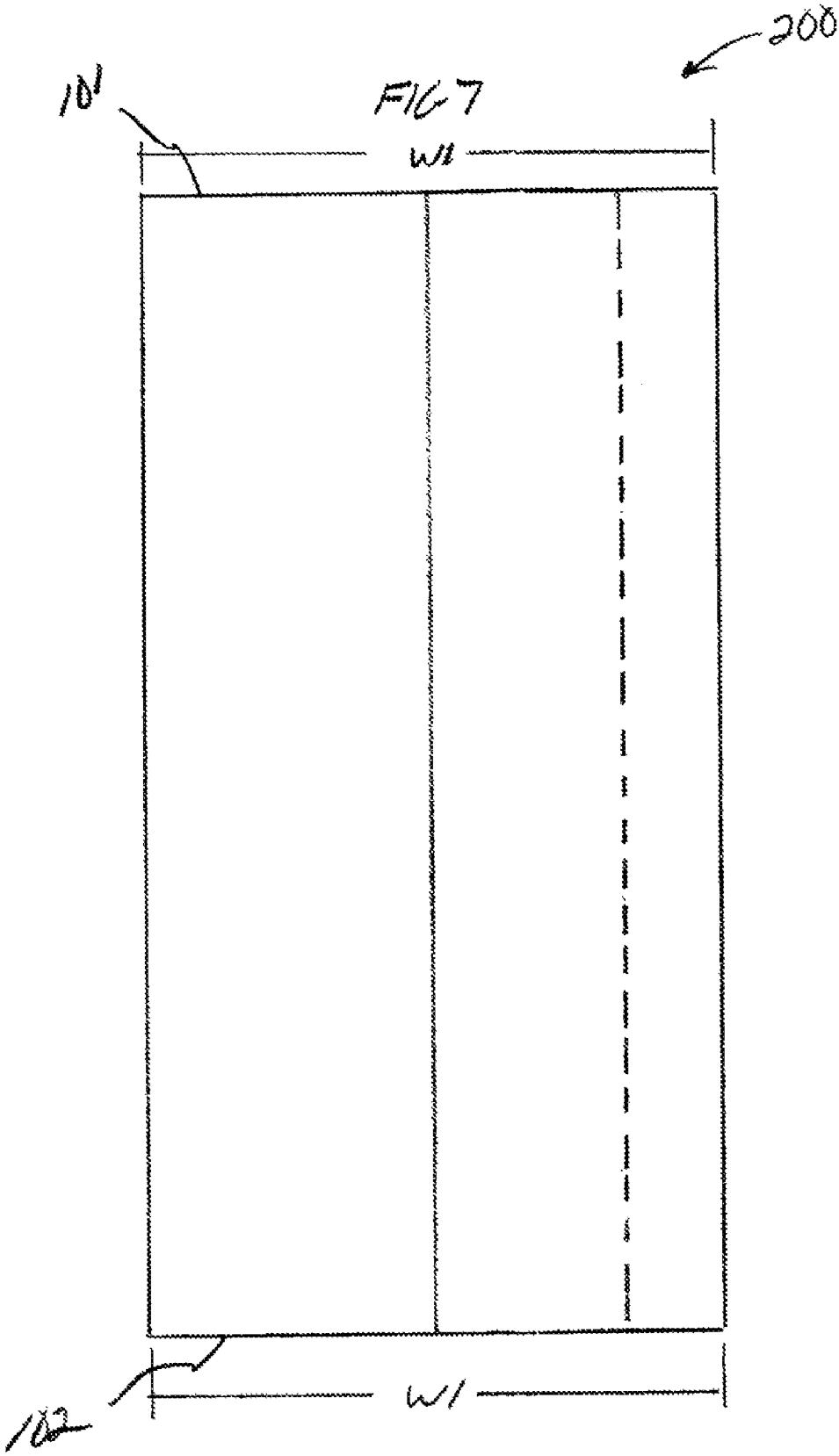
FIG. 7 illustrates another embodiment of the present invention.

FIG. 7 illustrates a configuration of the bed covering 200 that may be used when the bed covering is not in use. In this configuration, the pair of fastening devices 106 proximate to the head end of bed covering 200 may be used in addition to the buttons 104 and the button holes 105 to provide a uniform width W1 from the head end 101 to the foot end 102 to produce a neat and aesthetic appearance when the bedding is made-up.

Figure 8:
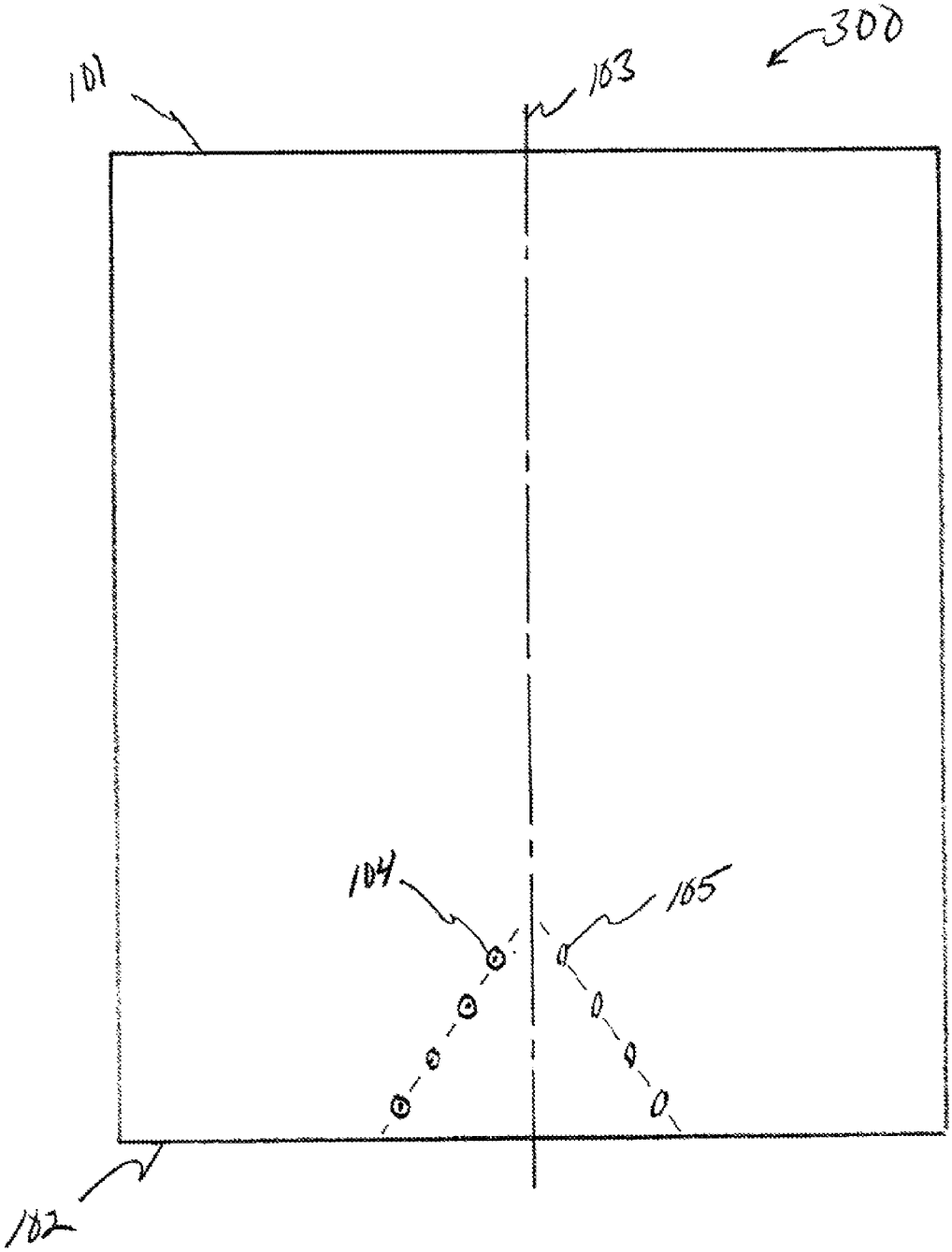
FIG. 8 illustrates a further embodiment of the present invention.

In one embodiment, as illustrated in FIG. 8, a bed covering 300 according to the present invention may have a first plurality of fastening devices, such as buttons 104, and a second plurality of fastening devices such as button holes 105, which may be positioned symmetrically with respect to center line 103 and arrayed on lines forming acute angles with respect to the center line 103, such that the distance between complementary fastening devices 104 and 105 decreases from the foot end 102 of bed covering 300 in a direction toward the head end 101 of bed covering 300. It will be appreciated by one skilled in the art that such an arrangement of fastening devices may operate to minimize the distortion of material in the vicinity of the fastening devices when the bed covering 300 is in a fastened configuration.

Figure 9:
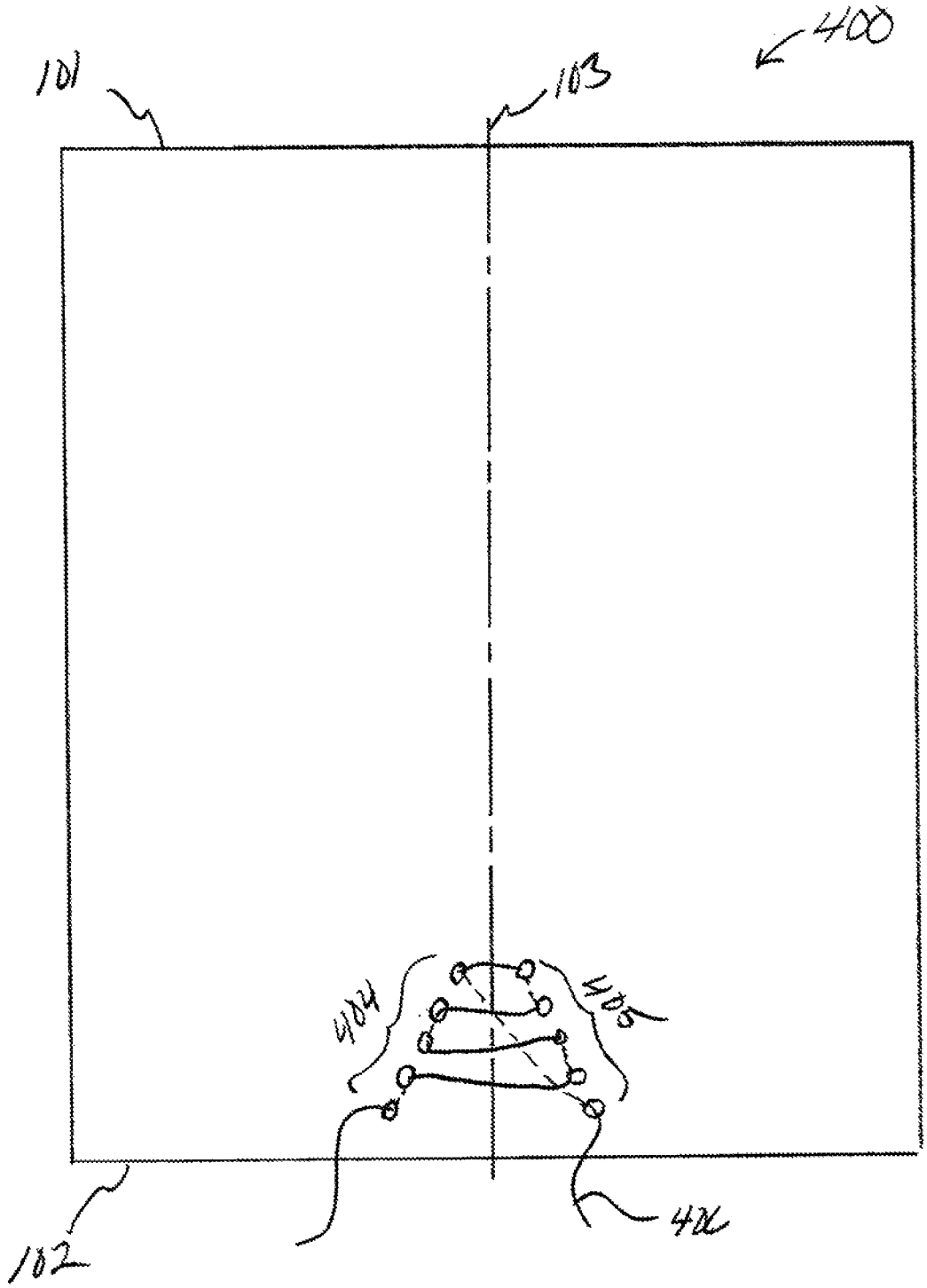
FIG. 9 illustrates an additional embodiment of the present invention.

FIG. 9 illustrates an alternative embodiment of a bed covering 400 where a first plurality of fastening elements 404 comprises a plurality of eyelets and a second plurality of fastening elements 405 also comprises a plurality of eyelets. Eyelets 404 and 405 may be threaded with a lace 406, for example, in a manner similar to the lacing of a shoe, wherein the eyelets are urged together when tension is applied to the lace, thereby reducing the width of the foot end 102.

Figure 10:
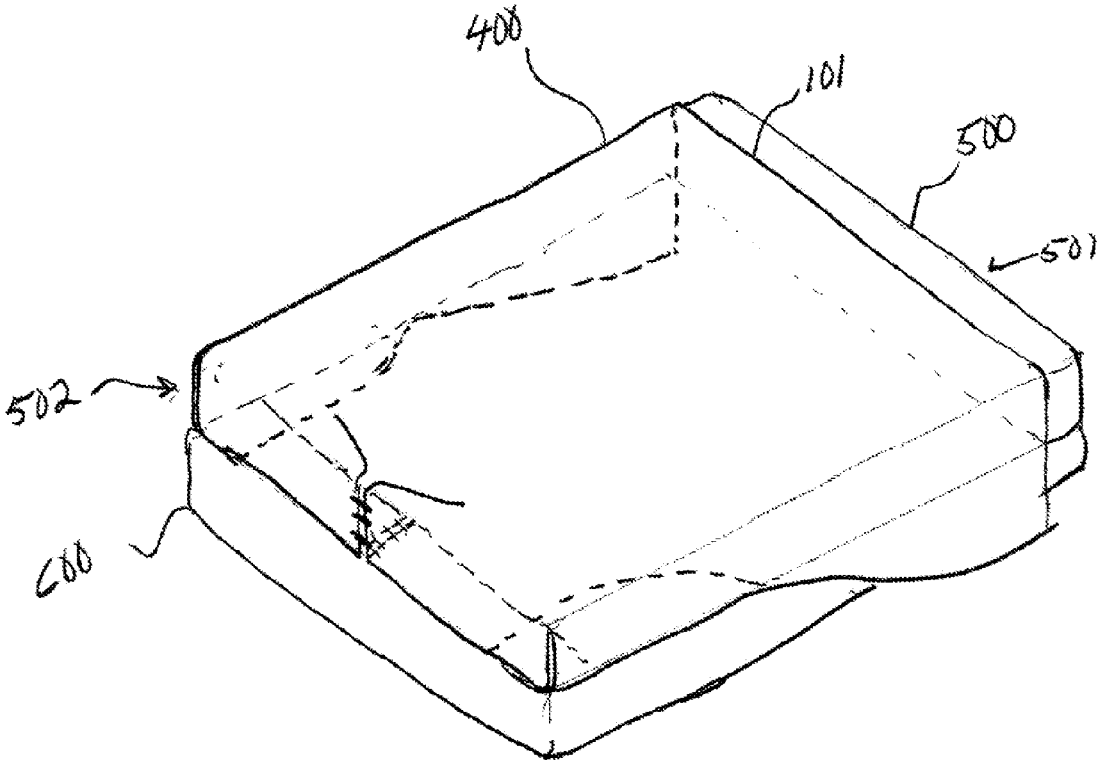
FIG. 10 illustrates an application of one embodiment of the present invention.

FIG. 10 illustrates one embodiment of the present invention where a bed covering, such as bed covering 400, for example, is applied to a sleeping platform, such as a mattress for example, in a fastened configuration as described above. In FIG. 10, the bed covering 400 is fitted to a mattress 500 that rests, for example, on a box spring support 600. Mattress 500 has a head end 501 and a foot end 502. In the embodiment illustrated in FIG. 10, the foot end 102 of bed covering 400 may be tucked under the foot end 502 of mattress 500, such that the foot end 102 is captured between mattress 500 and box spring support 600. The sides of the bed covering 400 proximate to the foot end 502 of mattress 500 may also be tucked under mattress 500 as illustrated in FIG. 10, while the sides of bed covering 400 proximate to the head end 101 of bed covering 400 may be allowed to hang to the sides of mattress 500 and box spring support 600, exposing the increased width W2 of the head end 101 as described above.

While this disclosure has been described in connection with specific embodiments thereof, it will be understood that it is capable of further modifications. This application is intended to cover any variations, uses, or adaptations of the disclosure following, in general, the principles of the disclosure and including such departures from the present disclosure as come within known or customary practice within the art to which the disclosure pertains and as may be applied to the essential features hereinbefore set forth.

What is claimed is:

1. A bed covering for a mattress of a bed, comprising:

a single-piece substantially rectangular fabric having a head end and a foot end;

a first plurality of fastening elements proximate to the foot end disposed on one side of a center line of the bed covering and configured to be tucked under a foot end of the mattress;

a second plurality of fastening elements proximate to the foot end disposed on an opposing side of the center line and configured to be tucked under the foot end of the mattress;

a pair of folding lines disposed on the bed covering to facilitate folding of the bed covering and to align a first plurality of fastening elements with a second plurality of fastening elements;

wherein the bed covering has a fastened configuration in which the first plurality of fastening elements are fastened to the second plurality of fastening elements and an unfastened configuration in which the first plurality of fastening elements are not fastened to the second plurality of fastening elements;

wherein, in the unfastened configuration, the head end of the bed covering has a width that is substantially the same as a width of the foot end of the bed covering; and wherein, in the fastened configuration, the width of the head end of the bed covering is wider than the width of the foot end of the bed covering to accommodate a sideways displacement of the bed covering.

2. The bed covering of claim 1, wherein the portion of the covering proximate to the foot end is configured to be folded over a corresponding foot end of a bed, wherein the one or more of the first plurality of fastening elements and the one or more of the second plurality of fastening elements is configured to be tucked under the foot end of the bed.

3. The bed covering of claim 1, further comprising a first fastening element proximate to the head end of the covering and disposed on the one side of the centerline, and a second fastening element proximate to the head end of the covering and disposed on the opposing side of the centerline, wherein fastening the first fastener element to the second fastener element configures the covering to a substantially uniform width less than the unfolded width.

4. The bed covering of claim 1, wherein the first plurality of fastening elements and the second plurality of fastening elements are disposed symmetrically with respect to the centerline.

5. The bed covering of claim 4, wherein the first plurality of fastening elements and the second plurality of fastening elements are arrayed on lines substantially parallel to the center line.

6. The bed covering of claim 4, wherein the first plurality of fastening elements and the second plurality of fastening elements are arrayed on lines forming acute angles with the centerline, wherein a distance between the lines decreases from the foot end of covering in a direction toward the head end of the covering.

7. The bed covering of claim 1, wherein the first plurality of fastening elements comprises buttons and the second plurality of fastening elements comprises button holes.

8. The bed covering of claim 1, wherein the first plurality of fastening elements and the second plurality of fastening elements comprise complementing snaps.

9. The bed covering of claim 1, wherein the first plurality of fastening elements comprises buckles and the second plurality of fastening elements comprises complementing straps.

10. The bed covering of claim 1, wherein the first plurality of fastening elements and the second plurality of fastening elements comprise ties.

11. The bed covering of claim 1, wherein the first plurality of fastening elements and the second plurality of fastening elements comprise eyelets, the bed covering further comprising a lace threaded through the eyelets, wherein the eyelets are urged together by applying tension to the lace.

12. A bed covering for a mattress of a bed, consisting essentially of:

a single-piece substantially rectangular fabric having a head end and a foot end;

a first plurality of fastening elements proximate to the foot end disposed on one side of a center line of the bed covering and configured to be tucked under a foot end of the mattress;

a second plurality of fastening elements proximate to the foot end, disposed on an opposing side of the center line and configured to be tucked under the foot end of the mattress;

a pair of folding lines disposed on the bed covering to facilitate folding of the bed covering and to align a first plurality of fastening elements with a second plurality of fastening elements;

wherein the bed covering has a fastened configuration in which the first plurality of fastening elements are fastened to the second plurality of fastening elements and an unfastened configuration in which the first plurality of fastening elements are not fastened to the second plurality of fastening elements;

wherein, in the unfastened configuration, the head end of the bed covering has a width that is substantially the same as a width of the foot end of the bed covering; and wherein, in the fastened configuration, the width of the head end of the bed covering is wider than the width of the foot end of the bed covering to accommodate a sideways displacement of the bed covering.

13. The bed covering of claim 12, wherein the folding lines are configured to facilitate a symmetrical folding of the covering with respect to the center line.

14. The bed covering of claim 12, wherein the folding lines are configured to facilitate a nonsymmetrical folding of the covering with respect to the center line.

* * * * *